US007360837B1

(12) United States Patent
Liu

(10) Patent No.: US 7,360,837 B1
(45) Date of Patent: Apr. 22, 2008

(54) BACKREST ADJUSTING DEVICE FOR CHAIR

(76) Inventor: Chia-Shan Liu, No. 132, Jhongyi Rd., Rende Township, Tainan County 717 (TW)

( * ) Notice: Subject to any disclaimer, the term of this patent is extended or adjusted under 35 U.S.C. 154(b) by 0 days.

(21) Appl. No.: 11/754,952

(22) Filed: May 29, 2007

(51) Int. Cl.
*B60N 2/02* (2006.01)

(52) U.S. Cl. ..... 297/353

(58) Field of Classification Search ..... 297/353, 297/411.36, 463.1
See application file for complete search history.

(56) References Cited

U.S. PATENT DOCUMENTS 4,639,039 A * 1/1987 Donovan ..... 297/353
4,749,230 A * 6/1988 Tornero ..... 297/353
5,695,249 A * 12/1997 Lotfi ..... 297/353
5,951,107 A * 9/1999 Tornero ..... 297/353
6,299,253 B1 * 10/2001 Chen ..... 297/353
2003/0057756 A1 * 3/2003 Lai ..... 297/353

* cited by examiner

*Primary Examiner*—Milton Nelson, Jr.
(74) *Attorney, Agent, or Firm*—Banger Shia

(57) ABSTRACT

A backrest adjusting device includes a fixing plate fixed to a chair seat. A block is pivotably received in a groove in a coupling seat fixed to the fixing plate. A portion of the fixing plate is received in a recess of a positioning board including a vertical slot and a plurality of vertically spaced slanted positioning holes in communication with the vertical slot. A positioning peg on the coupling seat is biased by an elastic element into one of the positioning holes. An engaging board is received in the recess and includes a sliding groove for slideably receiving a guide plate through which the peg extends. A back board is fixed to the positioning board and to a backrest of the chair. The positioning board is vertically movable to adjust a height of the backrest.

5 Claims, 11 Drawing Sheets

A - A

BACKREST ADJUSTING DEVICE FOR CHAIR

BACKGROUND OF THE INVENTION

1. Field of the Invention

The present invention relates to a backrest adjusting device for a chair allowing convenient, stable, and smooth adjustment of the height of the backrest of the chair.

2. Description of the Related Art

FIG. 11 of the drawings illustrates a chair with a conventional height adjusting device, wherein an L-shaped plate 3' is mounted between a backrest 1' and a seat 2'. Mounted to a rear of the backrest 1' is a coupling portion 11' that engages with an upper end of the L-shaped plate 3'. A tightening knob 12' is mounted to the coupling portion 11' and can be turned loose to allow adjustment of the height of the backrest 1'. After adjustment, the tightening knob 12' is turned in a reverse direction to tighten the L-shaped plate 3' and, thus, fix the height of the backrest 1'. However, adjustment of the height of the backrest 1' requires laborsome turning of the tightening knob 12'. Furthermore, the tightening effect is not reliable such that the backrest 1' is apt to slide.

SUMMARY OF THE INVENTION

An objective of the present invention is to provide a backrest adjusting device for a chair in which the height of the backrest of the chair can be adjusted in a convenient, stable, and smooth manner.

A backrest adjusting device for a chair in accordance with the present invention includes a fixing plate adapted to be fixed to a seat of a chair. A resilient positioning mechanism includes a coupling seat, a block, and an elastic element. The coupling seat is fixed to the fixing plate and includes a groove having an axle formed therein. The coupling seat further includes a stop protruding from an upper end thereof. The block is received in the groove and includes a first end having an axle hole through which the axle extends, allowing pivotal movement of the block in the groove. The block further includes a second end with a positioning pin. The elastic element is mounted between the coupling seat and the block for biasing the block. A guiding plate made of a slightly flexible material includes a resilient arm formed on and has a spacing from a lateral side thereof. The guiding plate further includes a guide hole having a horizontal hole portion and a vertical hole portion in communication with the horizontal hole portion. A positioning seat includes a positioning board, an engaging board, and a back board. The positioning board includes a recess for receiving the engaging board and the fixing plate. The positioning board further includes a vertical slot, with a plurality of vertically spaced slanted positioning holes extending upward from a vertical sidewall defining the vertical slot and at an acute angle with the vertical slot, and with the vertical slot including upper end lower ends free of the positioning holes to form upper and lower restraining portions. The engaging board includes a vertical opening in alignment with the vertical slot of the positioning board. The engaging board further includes a sliding groove in which the guiding plate is slideably received. The resilient arm of the guiding plate is deformed by and in tight engagement with one of two lateral walls defining the sliding groove. The other lateral side of the guiding plate presses against the other lateral wall defining the sliding groove under action of the resilient arm. The back plate is fixed to the positioning board and adapted to be fixed to a backrest of the chair.

The positioning pin of the block is extended through the horizontal hole portion of the guiding plate into one of the positioning holes.

The positioning board is movable upward until the positioning pin of the block is moved into and positioned in another one of the positioning holes under action of the elastic element.

The positioning board is movable further upward until the positioning pin of the block reaches the lower restraining portion of the vertical slot and is located in the vertical hole portion of the guiding plate, and the positioning board is then movable downward until the positioning pin of the block reaches the upper restraining portion of the vertical slot, allowing subsequent readjustment of a height of the positioning board.

Preferably, the fixing plate is substantially L-shaped and includes a horizontal section and a vertical section. The horizontal section is adapted to be fixed to the seat of the chair. The vertical section includes a mounting hole, and the coupling seat includes a protrusion received in the mounting hole. The coupling seat includes a stop face surrounding the protrusion and abutting against an outer face of the vertical section of the fixing plate.

Preferably, the coupling seat includes a first notch defined in a perimeter wall of the groove, the block further includes a second notch formed in a lateral side thereof, and the elastic element includes two ends respectively received in the first and second notches.

Preferably, the engaging board is made of a material with a low friction coefficient.

Preferably, the positioning board further includes a plurality of holes, and the engaging board includes a plurality of pegs engaged in the plurality of holes of the positioning board for securely fixing the engaging board in the recess of the positioning board.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
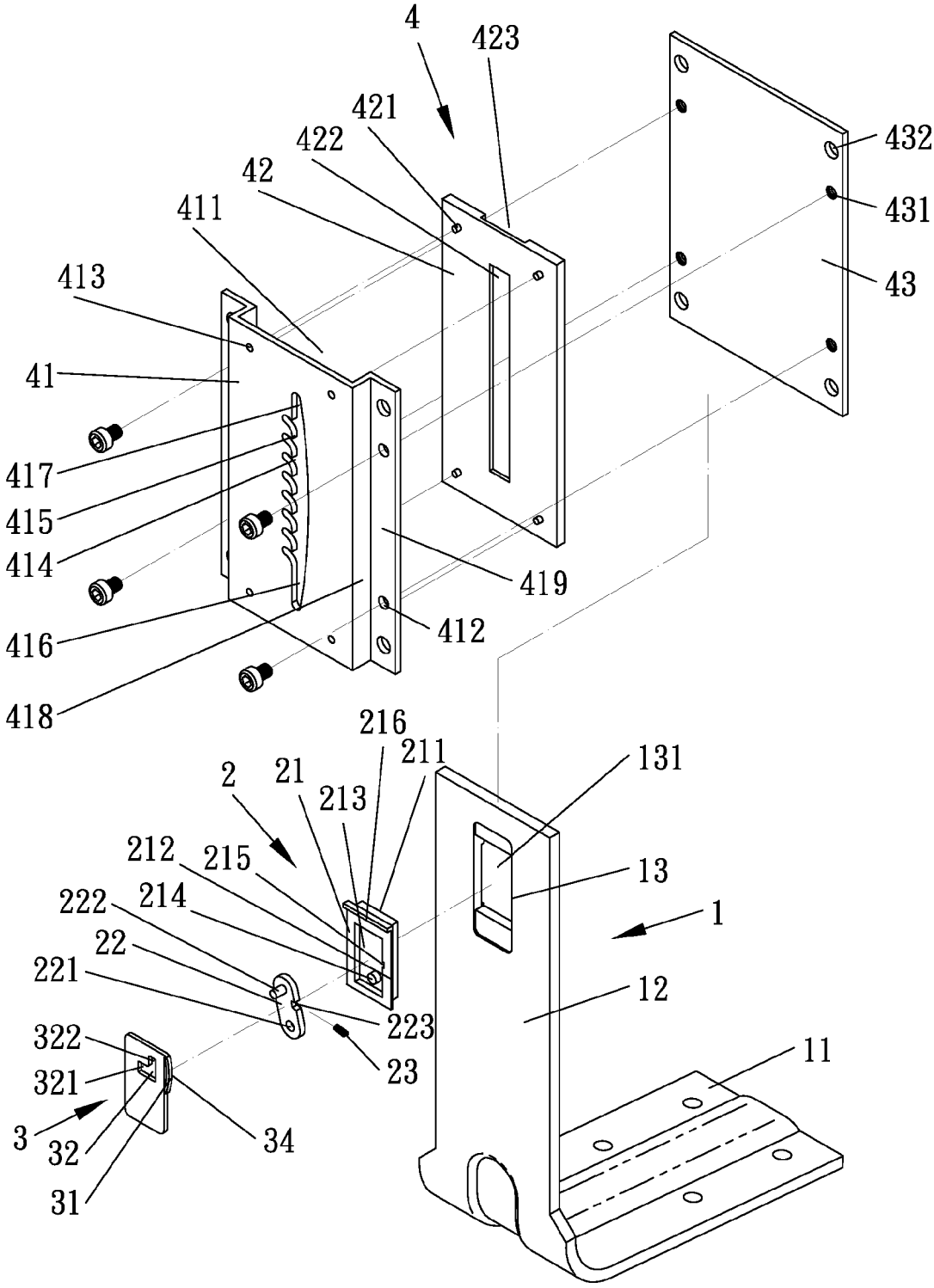
FIG. 1 is an exploded perspective view of a backrest adjusting device for a chair in accordance with the present invention.
Figure 2:
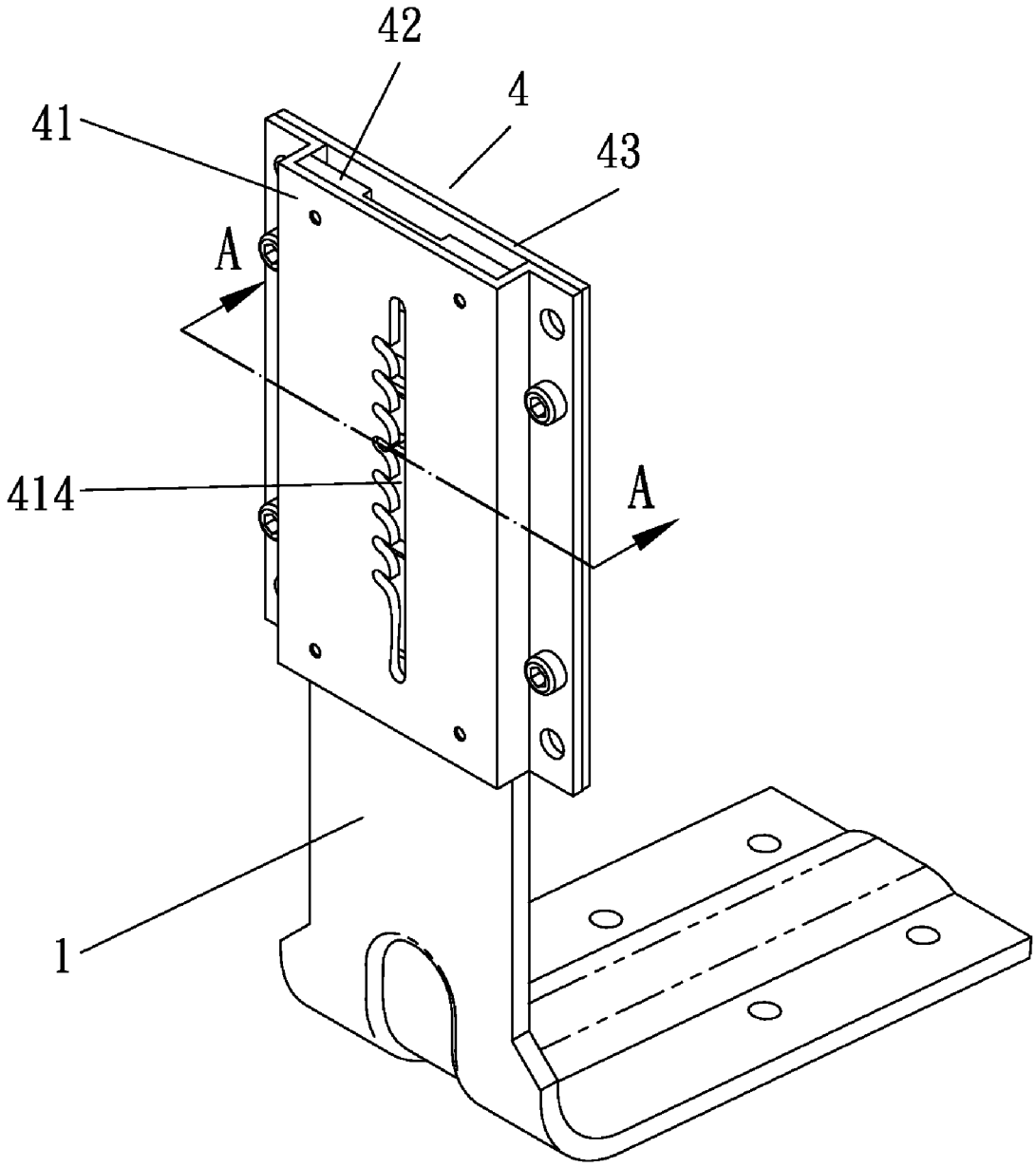
FIG. 2 is a perspective view of the backrest adjusting device of FIG. 1.
Figure 3:
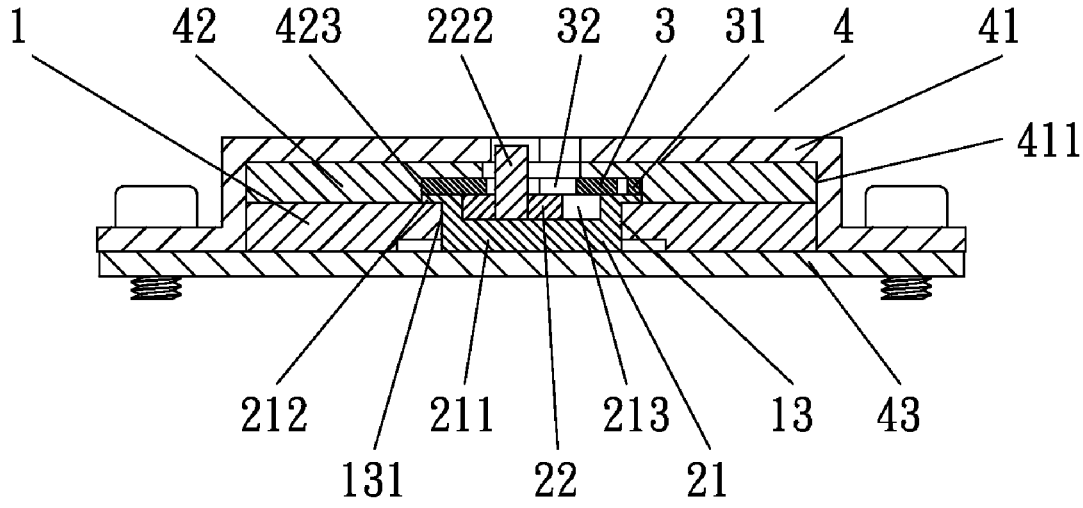
FIG. 3 is a sectional view taken along plane 3-3 in FIG. 2.
Figure 4:
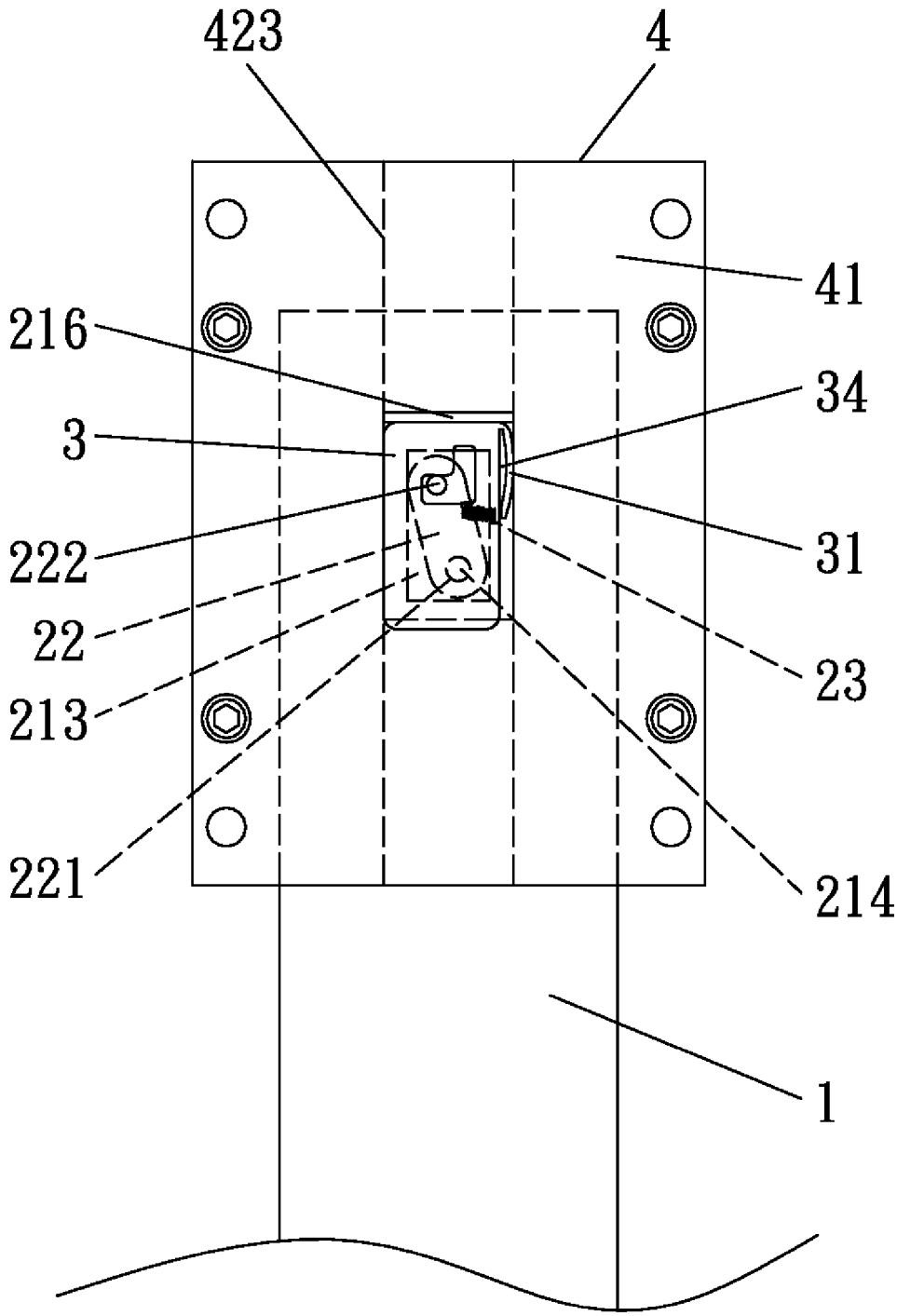
FIG. 4 is an elevational view of a resilient positioning mechanism, a guiding plate, and an engaging board after assembly.
Figure 5:
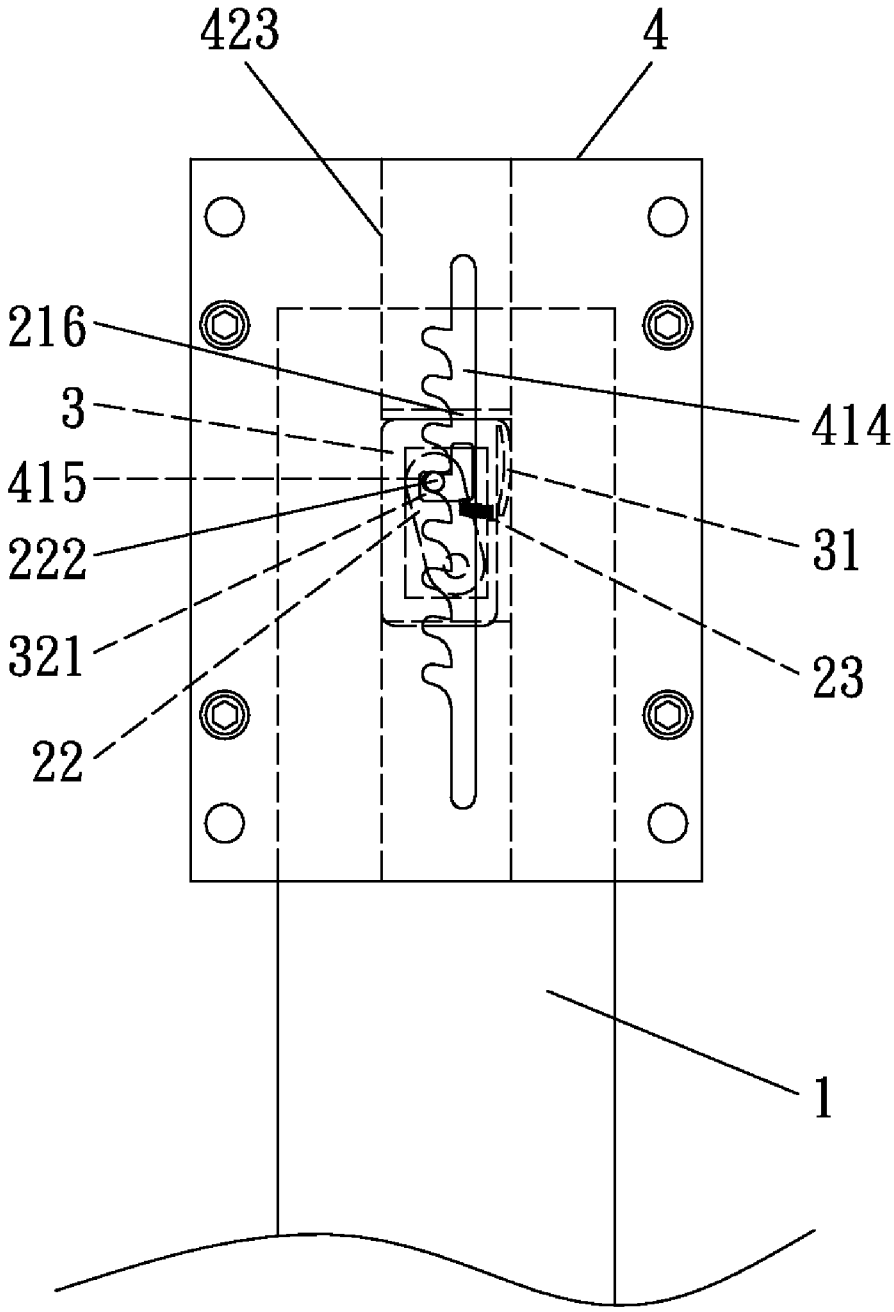
FIG. 5 is an elevational view of the backrest adjusting device of FIG. 2.

Referring to FIG. 1, a backrest adjusting device for a chair in accordance with the present invention includes a fixing plate 1, a resilient positioning mechanism 2, a guiding plate 3, and a positioning seat 4. The fixing plate 1 is substantially L-shaped and includes a horizontal section 11 coupled to a seat (not shown) of a chair (not shown) and a vertical section 12 to which the positioning seat 4 is mounted. The vertical section 12 includes a coupling portion 13 having a mounting hole 131 to which the resilient positioning mechanism 2 is mounted.

The resilient positioning mechanism 2 includes a coupling seat 21, a block 22, and an elastic element 23. The coupling seat 21 includes a protrusion 211 on a side thereof, with a stop face 212 surrounding the protrusion 211. The protrusion 211 is received in the mounting hole 131 of the fixing plate 1, with the stop face 212 abutting against an outer face of the fixing plate 1. Formed on the other side of the coupling seat is a groove 213, with the axle 214 formed on a bottom wall of the groove 213, and with a notch 215 defined in a perimeter wall of the groove 213 for receiving an end of the elastic element 23 (a spring in this example). A stop 216 projects from an upper end of the other side of the coupling seat 21. The block 22 is received in the groove 213 of the coupling seat 21 and includes an axle hole 221 in an end thereof and a positioning pin 222 formed on the other end thereof. The axle 214 is extended through the axle hole 221, allowing pivotal movement of the block 22 in the groove 213. A notch 223 is formed in a lateral side of the block 22 for receiving the other end of the elastic element 23.

The guiding plate 3 is made of a slightly flexible material and includes a resilient arm 31 formed on a lateral side thereof. The resilient arm 31 is substantially arcuate and has a spacing 34 from the lateral side of the guiding plate 3 to allow deformation of the resilient arm 31. The guiding plate 3 further includes a substantially L-shaped guiding hole 32 having a horizontal hole portion 321 and a vertical hole portion 322 in communication with the horizontal hole portion 321.

The positioning seat 4 includes a positioning board 41, an engaging board 42, and a back board 43. The positioning board 41 includes a vertical slot 414, with a plurality of vertically spaced slanted positioning holes 415 extending upward from a vertical sidewall defining the vertical slot 414 and at an acute angle with the vertical sot 414, and with upper end lower ends of the vertical slot 414 being free of the slanted positioning holes 415 to form upper and lower restraining portions 416 and 417. The positioning board 41 further includes two vertical walls 418 extending from two lateral edges of and perpendicular to the positioning board 41. A vertically extending recess 411 is defined between the positioning board 41 and the vertical walls 418 for receiving the engaging board 42 and the vertical section 12 of the fixing plate 1. The positioning board 41 further includes two vertical wings 419 extending from lateral edges of and perpendicular to the vertical walls 418 and parallel to the positioning board 41, with each vertical wing 419 including a plurality of engaging holes 412. Further, the positioning board 41 includes a plurality of holes 413 for receiving pegs 421 of the engaging board 42 that is made of a material with a low friction coefficient. Thus, the engaging board 42 is fixed in the recess 411 of the positioning board 41. The engaging board 42 further includes a vertical opening 422 in alignment with the vertical slot 414. The engaging board 42 further includes a sliding groove 423 in a side away from the positioning board 41. The guiding plate 3 is slideably received in the sliding groove 423, and the resilient arm 31 is deformed by and in tight engagement with a lateral wall defining the sliding groove 423. The back board 43 is fixed to the positioning plate 43 by extending fasteners (not shown) through engaging holes 431 in the back board 43 and the engaging holes 412 of the positioning board 41. The back board 43 further includes a plurality of engaging holes 432 for engagement with the backrest (not shown) of the chair.

With reference to FIGS. 1-5, in assembly, the coupling seat 21 is mounted into the mounting hole 131 of the fixing plate 1, with the axle hole 221 of the block 22 receiving the axle 214 of the coupling seat 21, with two ends of the elastic element 23 respectively pressing against the notches 215 and 223 respectively of the coupling seat 21 and the block 22. Then the engaging board 42 is mounted into the recess 411 of the positioning board 41. The guiding plate 3 is inserted into the sliding groove 423 of the engaging board 42. Next, the back board 43 is fixed to the positioning board 41. After assembly, the positioning peg 222 of the block 22 is extended through the horizontal hole portion 321 of the guiding plate 3 into one of the positioning holes 415 of the positioning board 41.

Figure 6:
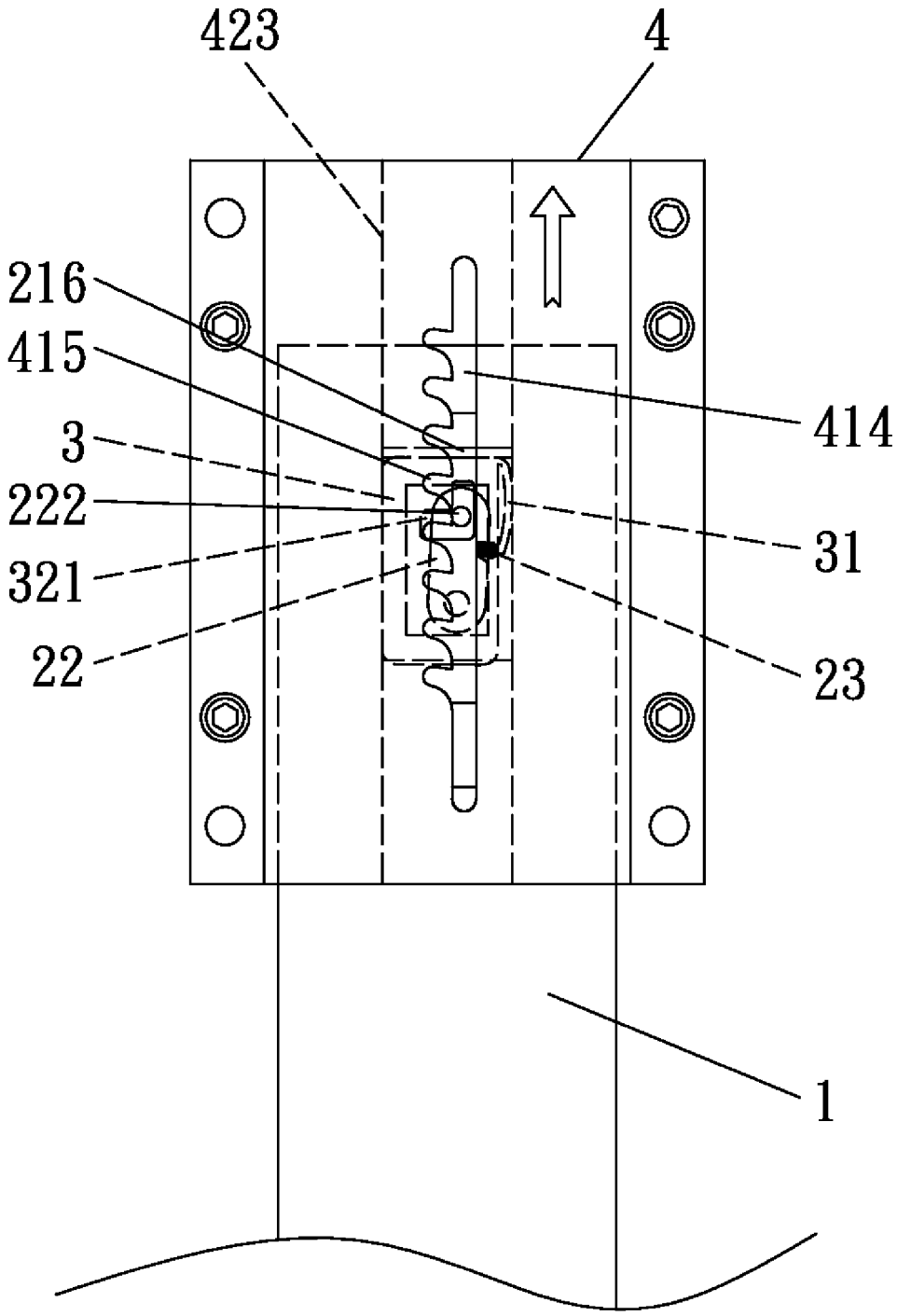
FIG. 6 is a view similar to FIG. 5, illustrating upward adjustment of an adjusting seat.
Figure 7:
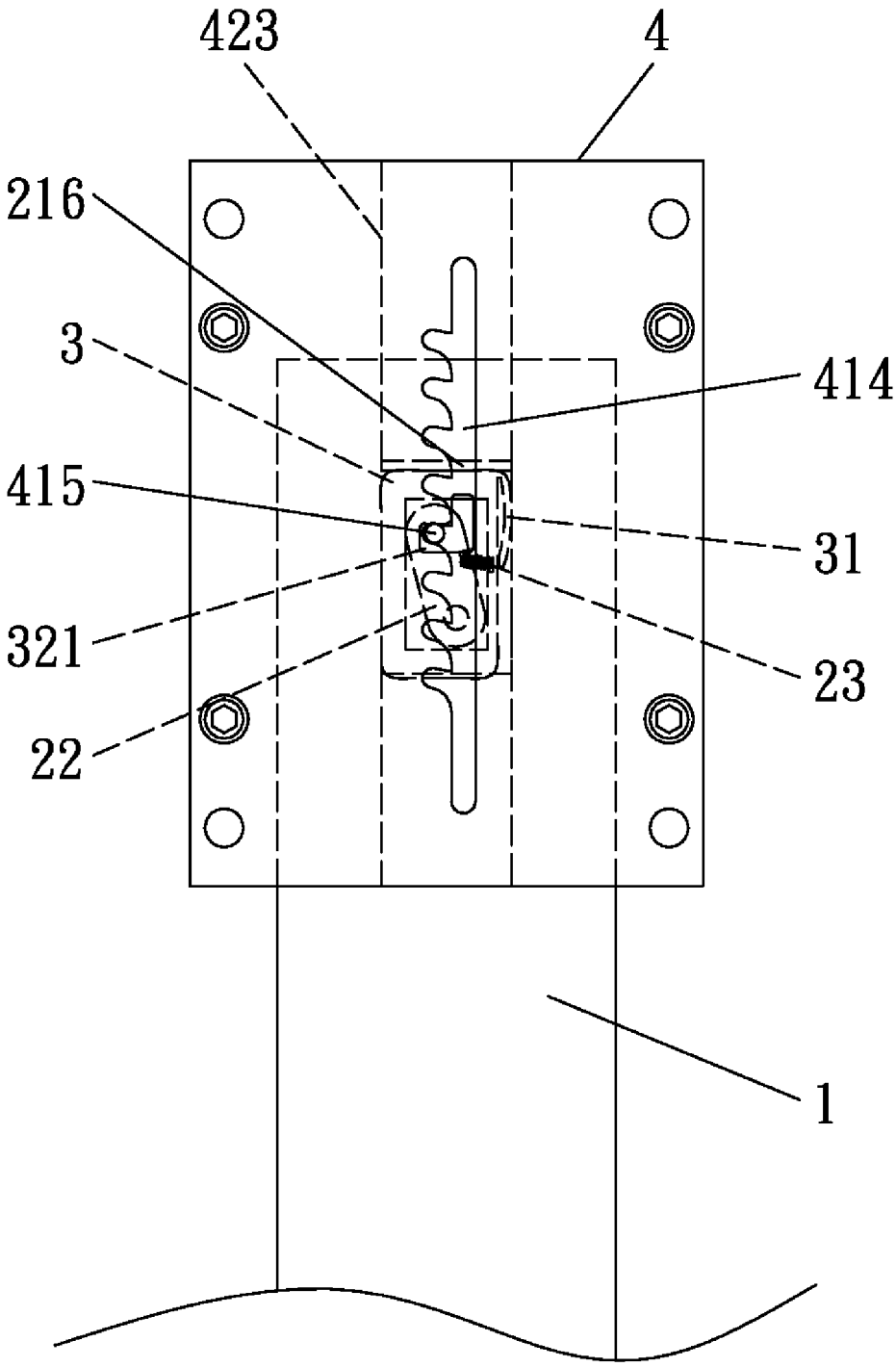
FIG. 7 is a view similar to FIG. 6, illustrating positioning after adjustment.

With reference to FIGS. 6 and 7, when adjustment of the height of the back rest is required, a user moves the positioning seat 4 upward, and the block 22 is biased by the elastic element 23 into another positioning hole 415 at a desired height. During upward movement of the positioning seat 4, the stop 216 of the coupling seat 21 abuts against a top of the guiding plate 3 to urge the guiding plate 3 to slide downward along the sliding groove 423 of the engaging board 42.

Figure 8:
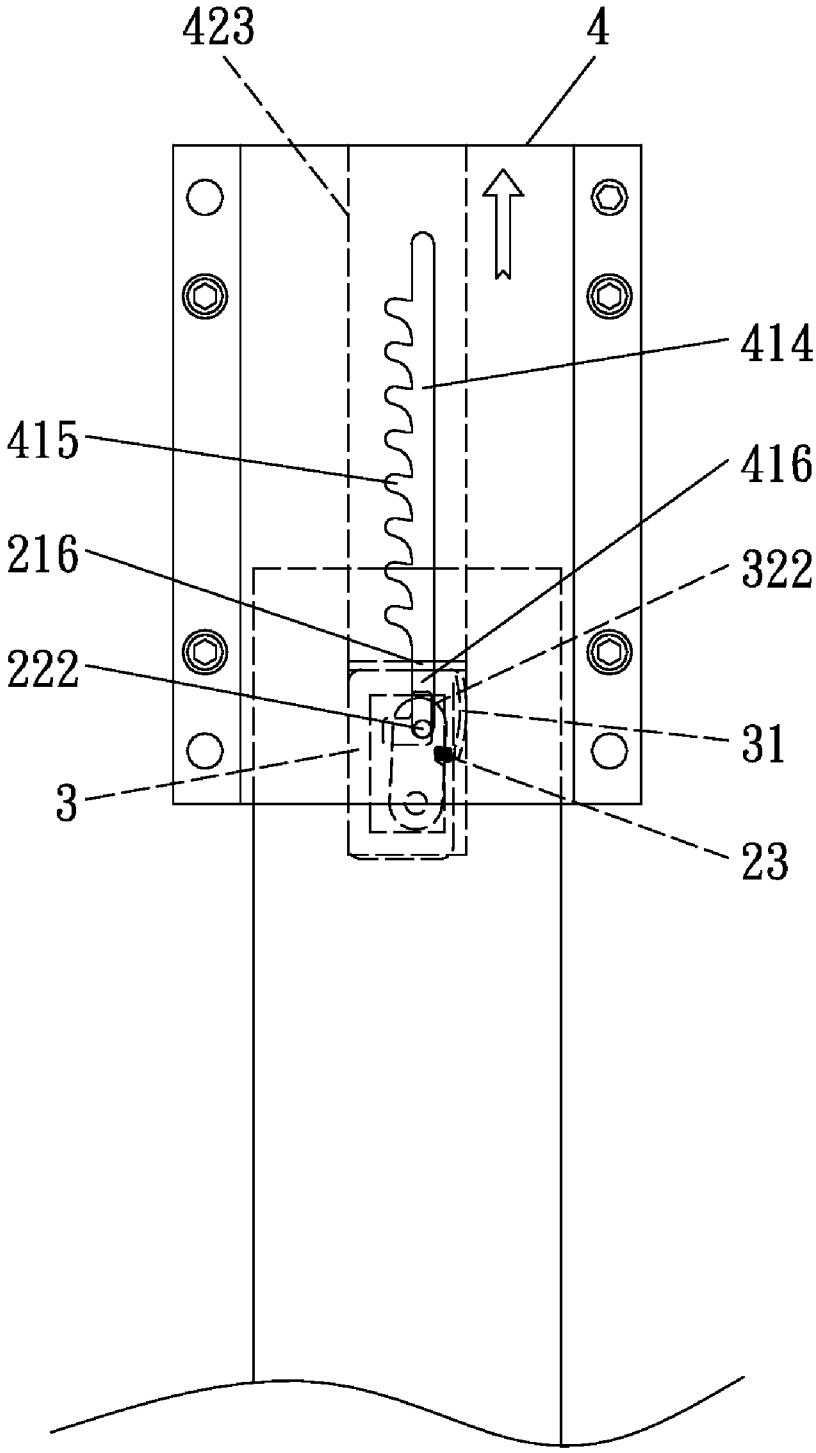
FIG. 8 is an elevational view illustrating a first stage of readjustment operation.
Figure 9:
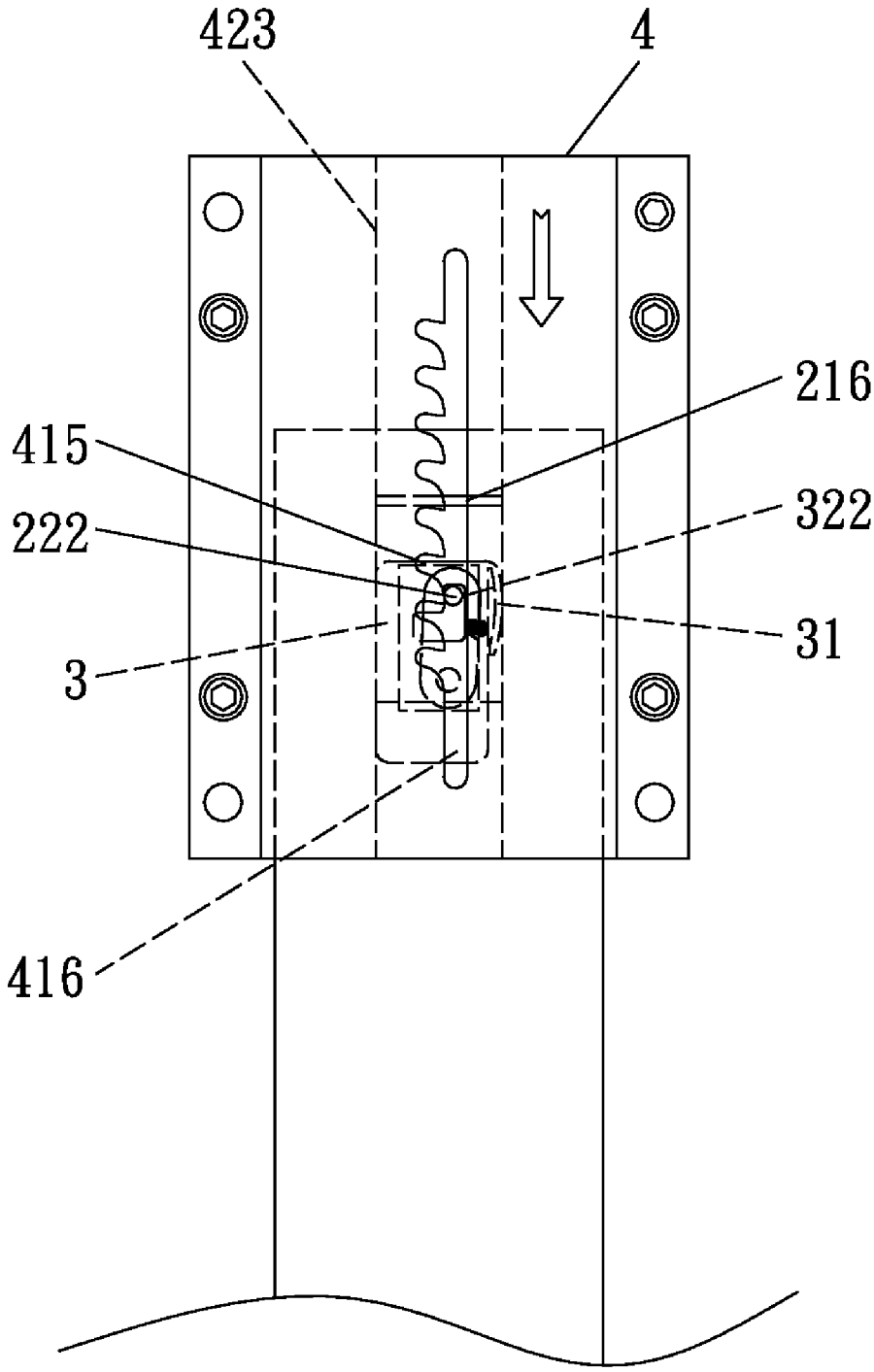
FIG. 9 is a view similar to FIG. 8, illustrating a second stage of readjustment operation.

With reference to FIGS. 8 and 9, when readjustment of the height of the back rest is required, in the first stage, the user moves the positioning seat 4 upward until the positioning pin 222 of the block 22 reaches the lower restraining portion 416 of the vertical slot 414 of the positioning board 41, as shown in FIG. 8. It is noted that the positioning peg 222 of the block 22 is in an end portion of the vertical hole portion 322 of the guide hole 32 of the guiding plate 3. In the second stage, the user moves the positioning seat 4 downward. The other lateral side of the guiding plate 3 is biased by the resilient arm 31 to tightly press against the other lateral wall defining the sliding groove 423 whereas the resilient arm 31 is deformed by and in tight engagement with the lateral wall defining the sliding groove 423 such that the positioning pin 222 of the block 22 is retained in the vertical hole portion 322 of the guide hole 32 of the guiding plate 3, as shown in FIG. 9. More specifically, the positioning pin 222 of the block 22 will not enter the positioning holes 415 during downward movement of the positioning seat 4.

Figure 10:
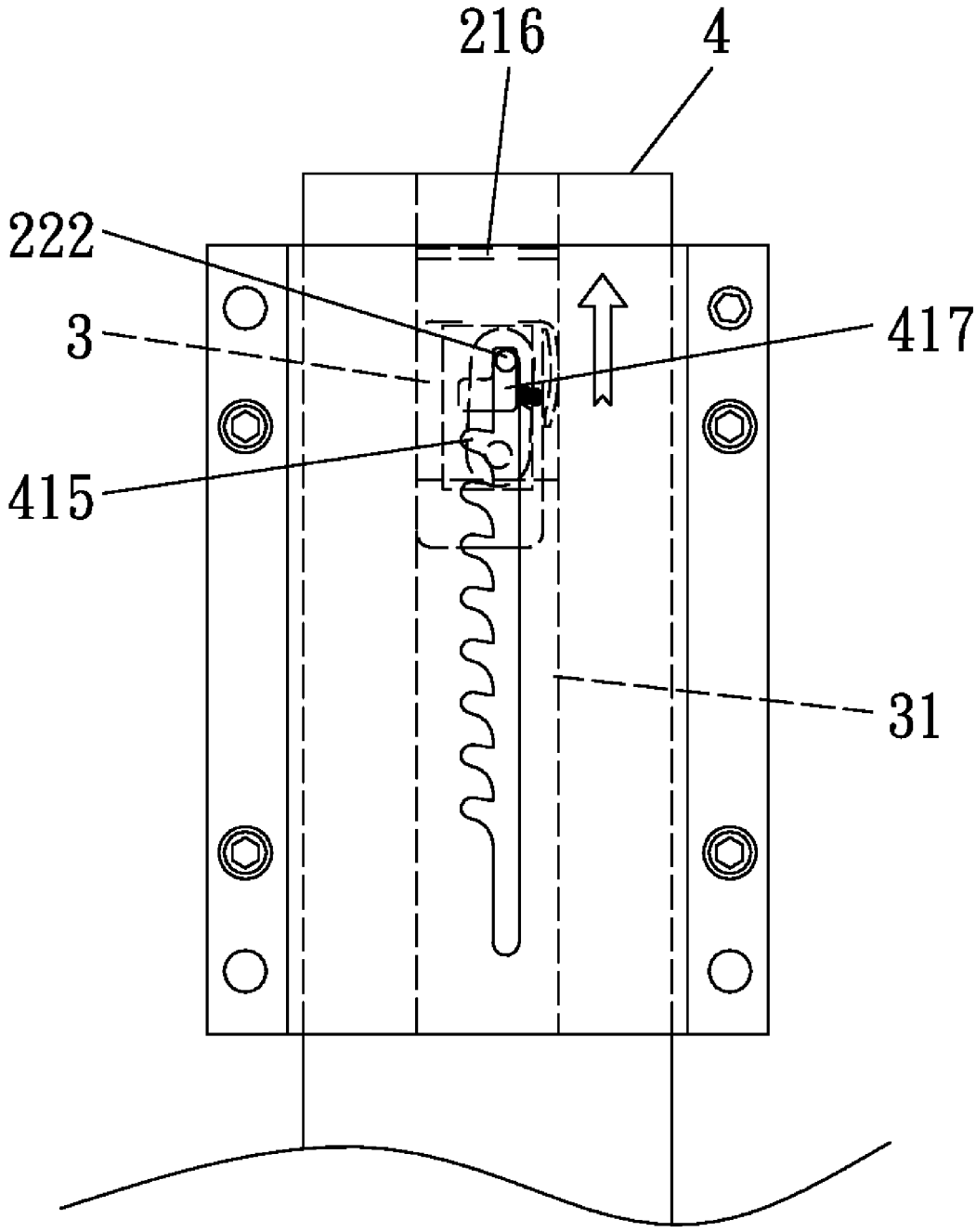
FIG. 10 is a view similar to FIG. 9, illustrating a third stage of readjustment operation.
Figure 11:
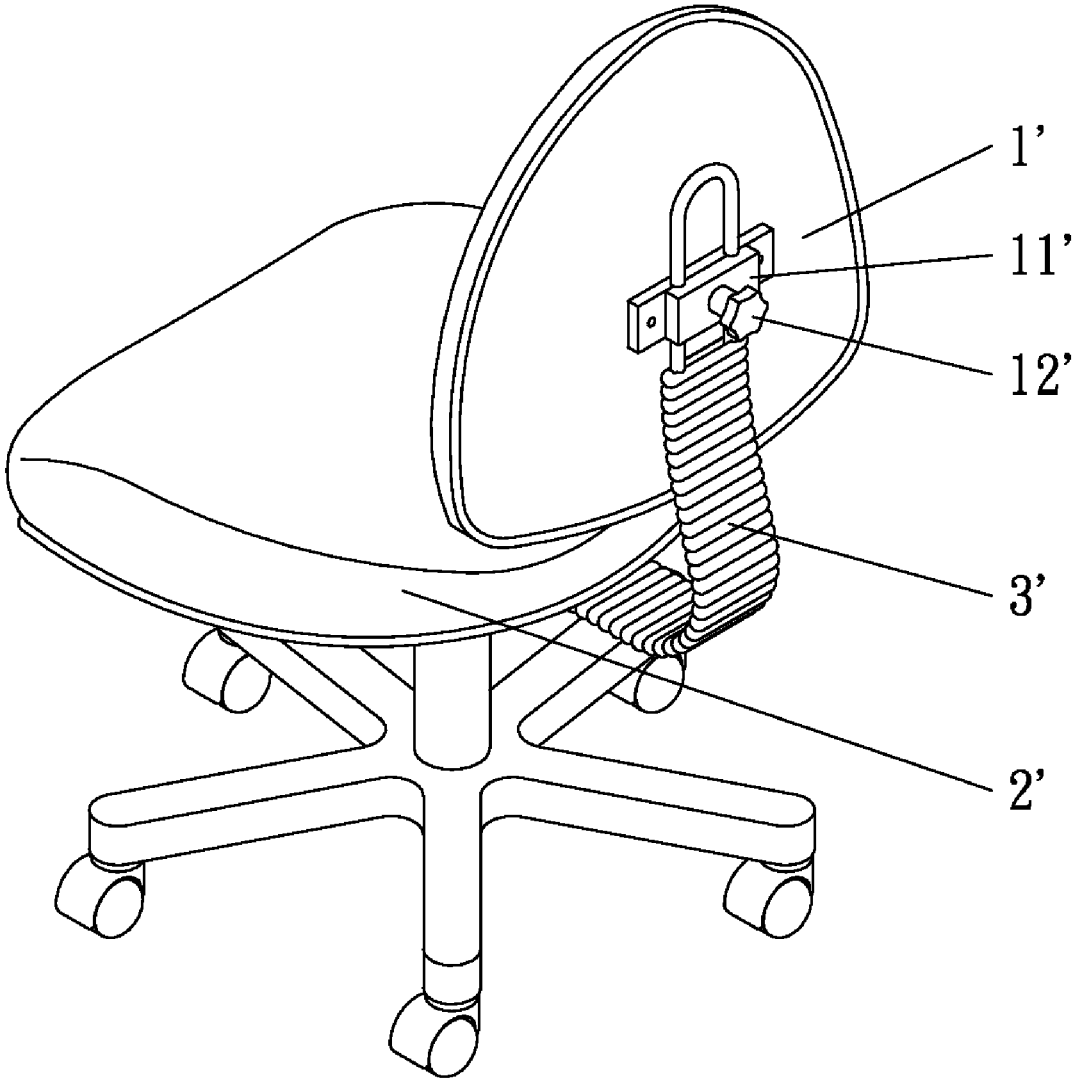
F I G . 11(PRIOR ART)
FIG. 11 shows a perspective view of a chair with a conventional backrest adjusting device.

With reference to FIG. 10, after the positioning pin 222 of the block 22 reaches the upper restraining portion 417 of the vertical slot 414, the user may move the positioning seat 4 upward again until the backrest reaches the desired height. It is noted that the stop 216 presses against the guiding plate 3 to move the guiding plate 3 downward along the sliding groove 423 of the engaging board 42 (see FIGS. 6 and 7).

Although a specific embodiment has been illustrated and described, numerous modifications and variations are still possible without departing from the teachings of the invention. The scope of the invention is limited by the accompanying claims.

What is claimed is:

1. A backrest adjusting device for a chair comprising:

a fixing plate adapted to be fixed to a seat of a chair;

a resilient positioning mechanism comprising a coupling seat, a block, and an elastic element, with the coupling seat being fixed to the fixing plate and including a groove having an axle formed therein, with the coupling seat further including a stop protruding from an upper end thereof, with the block being received in the groove and including a first end having an axle hole through which the axle extends, allowing pivotal movement of the block in the groove, with the block further including a second end with a positioning pin, with the elastic element being mounted between the coupling seat and the block for biasing the block;

a guiding plate made of a slightly flexible material and including a resilient arm formed on and having a spacing from a later side thereof, with the guiding plate further including a guide hole having a horizontal hole portion and a vertical hole portion in communication with the horizontal hole portion; and a positioning seat comprising a positioning board, an engaging board, and a back board, with the positioning board including a recess for receiving the engaging board and the fixing plate, with the positioning board further including a vertical slot, with a plurality of vertically spaced slanted positioning holes extending upward from a vertical sidewall defining the vertical slot and at an acute angle with the vertical slot, with the vertical slot including an upper end and a lower end, both of which are free of positioning holes to form an upper restraining portion and a lower restraining portion, respectively, with the engaging board including a vertical opening in alignment with the vertical slot of the positioning board, with the engaging board further including a sliding groove in which the guiding plate is slideably received, with the resilient arm of the guiding plate being deformed by and in tight engagement with one of two lateral walls defining the sliding groove, with another lateral side of the guiding plate pressing against another lateral wall defining the sliding groove under action of the resilient arm, and with the back plate being fixed to the positioning board and adapted to be fixed to a backrest of the chair, with the positioning pin of the block being extended through the horizontal hole portion of the guiding plate into one of the positioning holes, with the positioning board being movable upward until the positioning pin of the block is moved into and positioned in another one of the positioning holes under action of the elastic element, and with the positioning board being movable further upward until the positioning pin of the block reaches the lower restraining portion of the vertical slot and is located in the vertical hole portion of the guiding plate, with the positioning board being then movable downward until the positioning pin of the block reaches the upper restraining portion of the vertical slot, allowing subsequent readjustment of a height of the positioning board.

2. The backrest adjusting device as claimed in claim 1 with the fixing plate being substantially L-shaped and including a horizontal section and a vertical section, with the horizontal section being adapted to be fixed to the seat of the chair, with the vertical section including a mounting hole, with the coupling seat including a protrusion received in the mounting hole, with the coupling seat further including a stop face surrounding the protrusion and abutting against an outer face of the vertical section of the fixing plate.

3. The backrest adjusting device as claimed in claim 1 with the coupling seat including a first notch defined in a perimeter wall of the groove, with the block further including a second notch formed in a lateral side thereof, and with the elastic element including two ends respectively received in the first and second notches.

4. The backrest adjusting device as claimed in claim 1 with the engaging board being made of a material with a low friction coefficient.

5. The backrest adjusting device as claimed in claim 1 with the positioning board further including a plurality of holes, with the engaging board including a plurality of pegs engaged in the plurality of holes of the positioning board for securely fixing the engaging board in the recess of the positioning board.

* * * * *